US007503817B2

(12) United States Patent
Ide et al.

(10) Patent No.: US 7,503,817 B2
(45) Date of Patent: Mar. 17, 2009

(54) OUTBOARD ENGINE SYSTEM

(75) Inventors: Shinichi Ide, Saitama (JP); Yoshiyuki Matsuda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/798,626

(22) Filed: May 15, 2007

(65) Prior Publication Data

US 2008/0014805 A1 Jan. 17, 2008

(30) Foreign Application Priority Data

May 25, 2006 (JP) ..... 2006-145964

(51) Int. Cl.
*B63H 20/32* (2006.01)

(52) U.S. Cl. ..... 440/76

(58) Field of Classification Search ..... 440/75, 440/76

See application file for complete search history.

(56) References Cited

U.S. PATENT DOCUMENTS 3,407,600 A * 10/1968 Meyer ..... 60/337
6,146,222 A * 11/2000 Murata et al. ..... 440/83

FOREIGN PATENT DOCUMENTS

JP 362191297 A * 8/1987

* cited by examiner

*Primary Examiner*—Lars A Olson
(74) *Attorney, Agent, or Firm*—Arent Fox LLP

(57) ABSTRACT

An outboard engine system includes: an engine; a casing to which the engine is removably mounted at an upper portion; a torque converter; a vertically arranged output shaft connected to a crankshaft via the torque converter; a horizontally arranged propeller shaft provided below the output shaft; and a forward-reverse shifting gear mechanism for providing a connection between the output shaft and the propeller shaft. The casing includes: casing main sections for housing the output shaft, the propeller shaft, and the forward-reverse shifting gear mechanism; and distance members removably jointed to the upper end of the casing main sections so as to house the torque converter. Both the casing main sections and the distance members are configured to be able to removably mount the engine. Thus, the casing having the main sections can be used in both an outboard engine system with a torque converter and an outboard engine system without a torque converter.

11 Claims, 6 Drawing Sheets

OUTBOARD ENGINE SYSTEM

RELATED APPLICATION DATA

The present invention is based upon Japanese priority application No. 2006-145964, which is hereby incorporated in its entirety herein by reference.

BACKGROUND OF THE INVENTION

1. Field of the Invention

The present invention relates to an improvement of an outboard engine system, including: an engine; a casing to which the engine is removably mounted at an upper portion; a torque converter; a vertically arranged output shaft connected to a crankshaft via the torque converter; a horizontally arranged propeller shaft provided below the output shaft; and a forward-reverse shifting gear mechanism for providing a connection between the output shaft and the propeller shaft.

2. Description of the Related Art

Such an outboard engine systems is already known as disclosed in U.S. Pat. No. 3,407,600.

The outboard engine system disclosed in U.S. Pat. No. 3,407,600 has a casing which can be used only in an outboard engine system with a torque converter, and cannot be used in an outboard engine system without a torque converter. Therefore, if the outboard engine system does not have a torque converter, a different casing corresponding to the system is required. That is, depending on the presence or absence of a torque converter, an exclusive casing is prepared for each system. Thus, in both systems, it is difficult to reduce the cost.

SUMMARY OF THE INVENTION

The present invention has been achieved in view of the above problem, and has an object to achieve cost reduction in both an outboard engine system with a torque converter and an outboard engine system without torque converter, by providing a casing main section which can be used in both the outboard engine systems.

In order to achieve the above object, according to the present invention, there is provided an outboard engine system, including: an engine; a casing to which the engine is removably mounted at an upper portion; a torque converter; a vertically arranged output shaft connected to a crankshaft via the torque converter; a horizontally arranged propeller shaft provided below the output shaft; and a forward-reverse shifting gear mechanism for providing a connection between the output shaft and the propeller shaft, wherein the casing includes: a casing main section for housing the output shaft, the propeller shaft, and the forward-reverse shifting gear mechanism; and a distance member removably jointed to an upper end of the casing main section so as to house the torque converter, and wherein both the casing main section and the distance member are configured to be able to removably mount the engine.

The main section of the casing of the present invention corresponds to an extension case 10, a mount case 11, and a gear case 12 of an embodiment of the present invention which will be described below, and the distance member of the present invention corresponds to lower and upper distance members 13 and 15 of the embodiment.

According to the present invention, in the case of an outboard engine system with a torque converter, the distance member is coupled to the casing main section, and the engine is mounted to the upper portion of the distance member while housing the torque converter in the distance member. In the case of an outboard engine system without a torque converter, the engine is mounted directly to the upper portion of the casing main sections without using the distance member. In this way, the casing main section can be commonly used in both the outboard engine systems, thereby reducing the cost in both the outboard engine systems.

The above-mentioned object, other objects, characteristics, and advantages of the present invention will become apparent a preferred embodiment, which will be described in detail below by reference to the attached drawings.

DESCRIPTION OF THE PREFERRED EMBODIMENT

Figure 1:
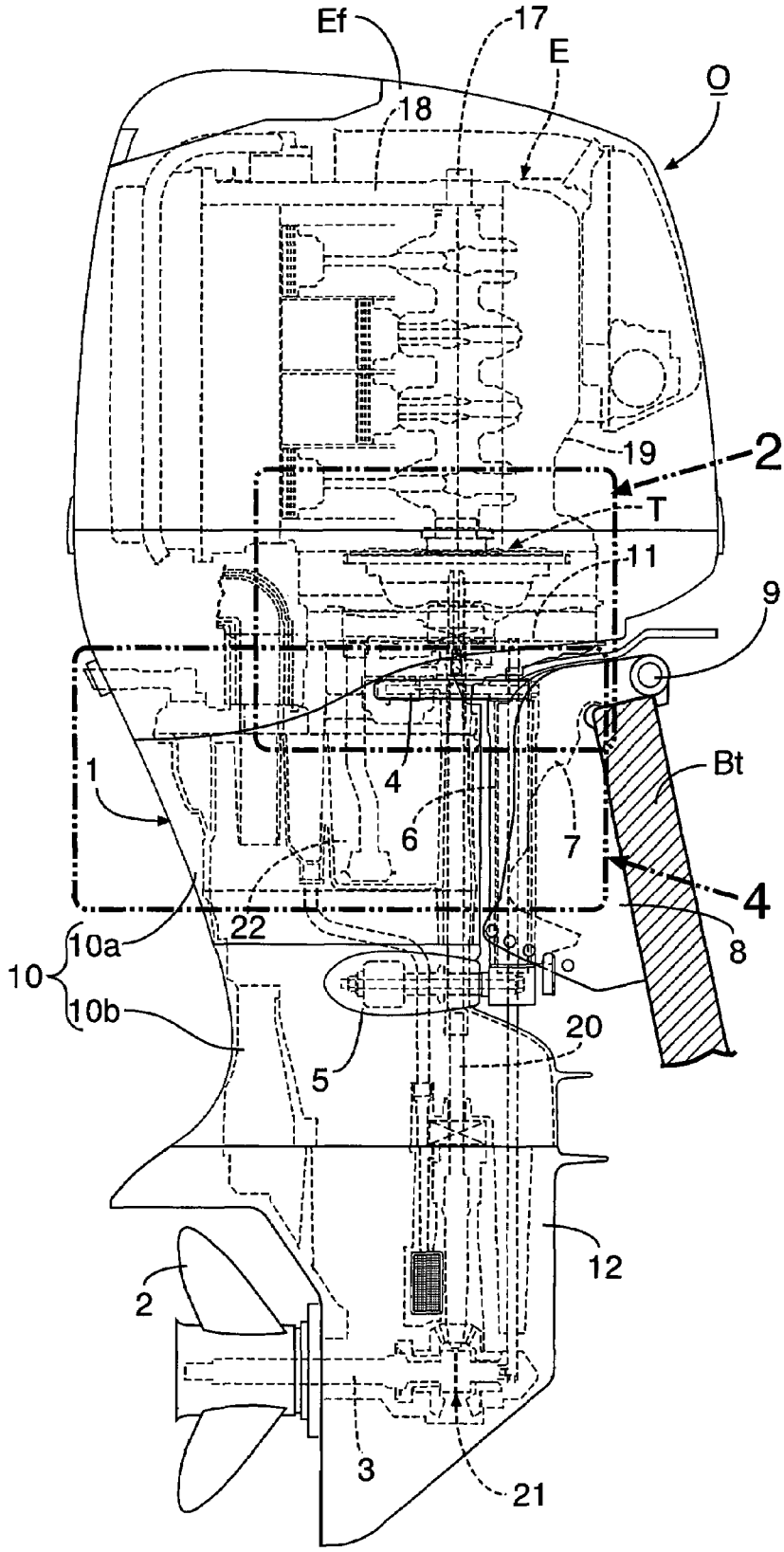
FIG. 1 is a side view showing an outboard engine system with a torque converter according to an embodiment of the present invention.

In FIG. 1, an outboard engine system O includes a casing 1 which has a water-cooled multi-cylinder four-stroke engine E mounted in its upper portion, and supports a propeller shaft 3 at its lower portion. The propeller shaft 3 has a propeller 2 provided at its rear end. A vertically-extending swivel shaft 6 is mounted to the casing 1 via an upper arm 4 and a lower arm 5 so as to situate in front of the casing 1. The swivel shaft 6 is rotatably supported by a swivel case 7 which is coupled to a stern bracket 8 via a horizontally-extending tilt shaft 9. The stern bracket 8 is cramped to a transom Bt of a body of a ship. Therefore, the casing 1 is horizontally rotatable around the swivel shaft 6, and vertically tiltable around the tilt shaft 9. The reference numeral Ef denotes a removable engine hood for covering the engine E.

Figure 2:
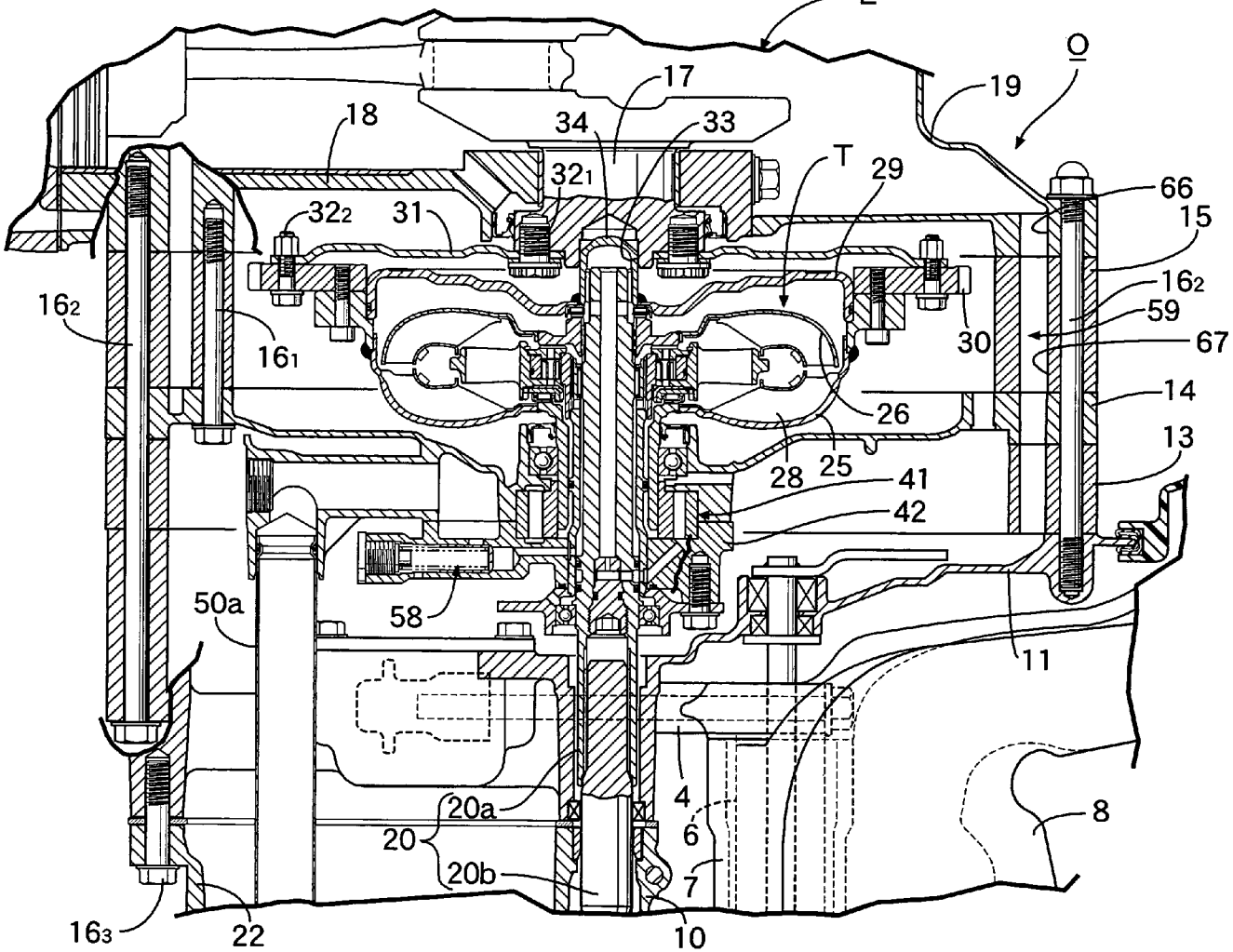
FIG. 2 is an enlarged sectional view showing the portion 2 of FIG. 1.
Figure 3:
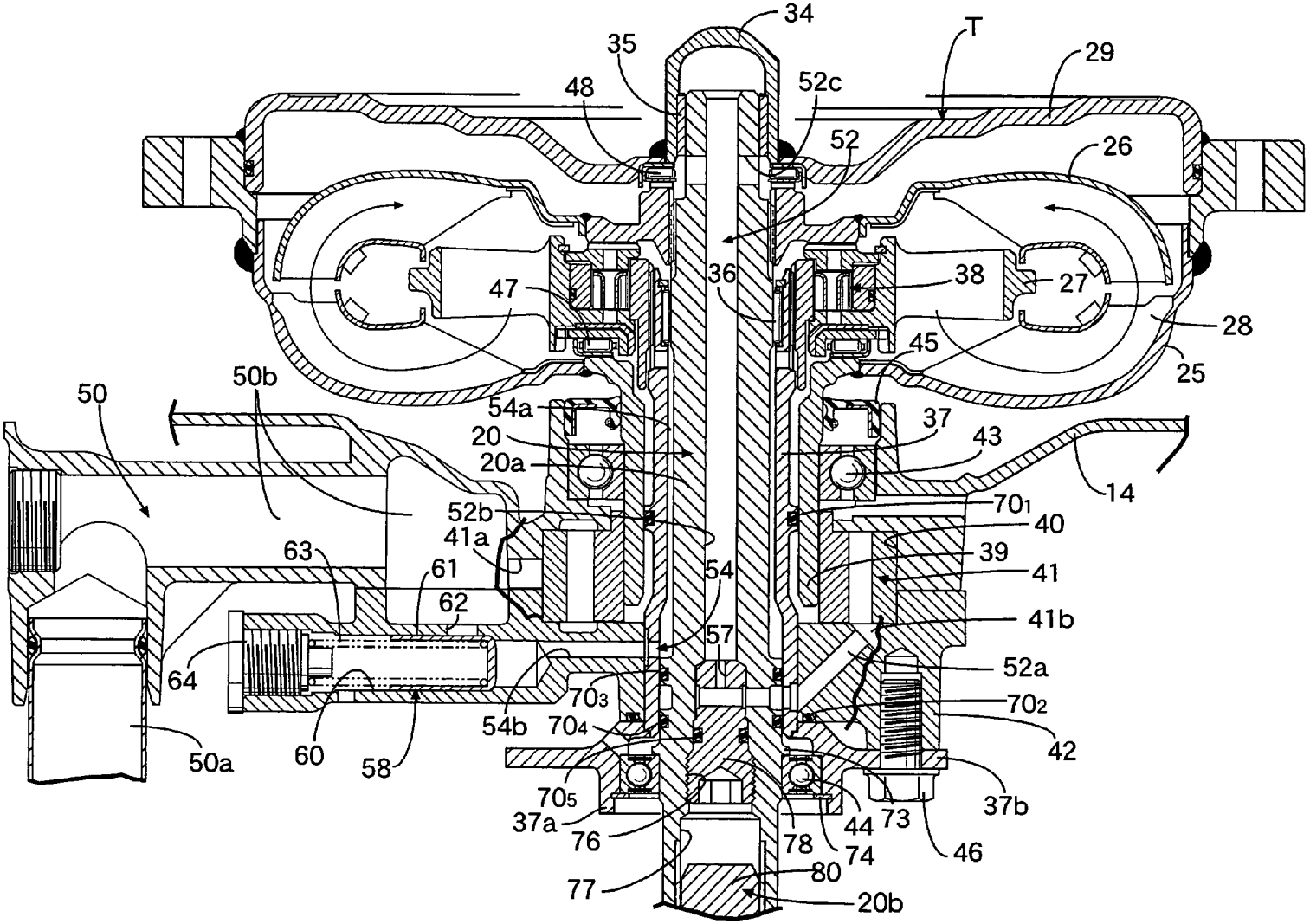
FIG. 3 is an enlarged view showing the essential portions of FIG. 2.
Figure 4:
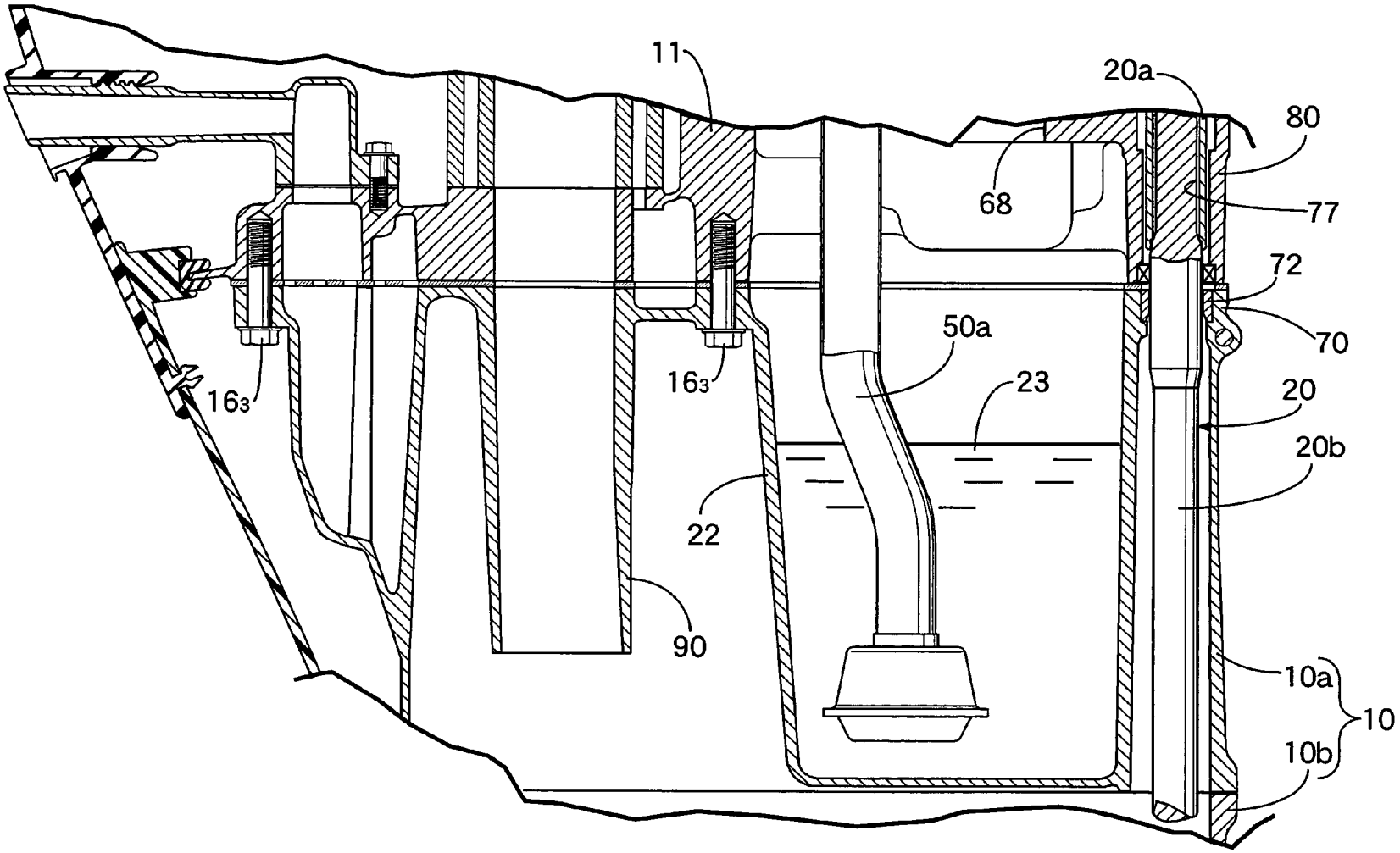
FIG. 4 is an enlarged sectional view showing the portion 4 of FIG. 1.

In FIG. 2, FIG. 3 and FIG. 4, the above casing 1 includes the extension case 10, the mount case 11 bolt-coupled to an upper end of the extension case 10, and a gear case 12 bolt-coupled to a lower end of the extension case 10. The extension case 10 includes an upper case 10*a* and a lower case 10*b* bolt-coupled to the upper case 10*a*. The mount case 11 is jointed to an upper end surface of the upper case 10*a* by a plurality of bolts $\mathbf{16}_3$.

The casing 1 further includes annular lower distance members 13, an oil pump holder 14, and annular upper distance members 15, which are sequentially superimposed on the upper end of the mount case 11. The engine E is mounted to the upper distance member 15 with the crankshaft 17 being vertically arranged and the cylinder block 18 facing rearward. An oil pump holder 14 and upper distance member 15 are secured to the cylinder block 18 and a bottom wall of the crankcase 19 of the engine E by a plurality of bolts $\mathbf{16}_1$. The lower distance member 13, the oil pump holder 14, and the upper distance member 15 are secured to one another by a plurality of bolts $\mathbf{16}_2$.

In FIG. 2 and FIG. 3, the torque converter T is vertically arranged in the annular upper distance member 15, and the output shaft 20 coupled to the crankshaft 17 via the torque converter T is vertically arranged in the extension case 10.

The gear case 12 horizontally supports the propeller shaft 3 having the propeller 2 at its rear end, and houses a forward-reverse shifting gear mechanism 21 connecting the propeller shaft 3 to the output shaft 20.

In operation of the engine E, the power thereof is transmitted from the crankshaft 17 to the output shaft 20 via the torque converter T, and further to the propeller shaft 3 via the forward-reverse shifting gear mechanism 21, thereby driving the propeller 2. The rotational direction of the propeller 2 is controlled and switched by the forward-reverse shifting gear mechanism 21.

In the extension case 10, an oil tank 22 open to the mount case 11 is integrally formed with the upper case 10*a* of the extension case 10. The oil tank 22 stores oil 23 which is used in both lubrication of the engine E and operation of the torque converter T. A downstream end 90 of an exhaust gas passage of the engine E is integrally formed with the upper case 10*a*.

As clearly shown in FIG. 3, the torque converter T includes a pump impeller 25, a turbine runner 26 arranged above the pump impeller 25 and opposed to the pump impeller 25, a stator 27 arranged between the inner peripheral portions of the pump impeller 25 and the turbine runner 26, and a circulation circuit 28 of working oil which is defined between these three impellers 25 to 27. The three impellers 25 to 27 are arranged to have a common vertical axis, as in the case of the crankshaft 17 and the output shaft 20.

The pump impeller 25 integrally includes a transmission cover 29 for covering an upper surface of the turbine runner 3. A ring gear 30 for starting operation is secured to an outer peripheral surface of the transmission cover 29. A drive plate 31 is secured to the ring gear 30 by a bolt $\mathbf{32}_2$. The drive plate 31 is also secured to a lower end surface of the crankshaft 17 by a bolt $\mathbf{32}_1$. The torque converter T is suspended from the crankshaft 17 via the drive plate 31.

A cup-shaped supporting cylinder 34 is secured to a central part of the transmission cover 29. The supporting cylinder 34 is fitted into a supporting hole 33 which is open to the central part of the lower end surface of the crankshaft 17. The output shaft 20 has an upper end which extends to the inside of the supporting cylinder 34 and is supported in the supporting cylinder 34 via a bearing bush 35. A hub of the turbine runner 26 is spline-coupled to the output shaft 20. A hollow stator shaft 37 is arranged around the outer periphery of the output shaft 20 so as to be supported by the output shaft 20 via a needle bearing 36. A known free wheel 38 is interposed between the stator shaft 37 and the hub of the stator 27.

A hollow pump shaft 39 is arranged at the outer periphery of the stator shaft 37. The hollow pump shaft 39 is integrally coupled to the pump impeller 25 and extends downward. The pump shaft 39 is supported by the oil pump holder 14 via an upper ball bearing 43 on the side of the outer periphery. An oil pump 41 driven at the lower end portion of the pump shaft 39 is attached to a pump housing 40 formed at a lower surface of an oil pump holder 14. A pump cover 42 covering a lower surface of the oil pump 41 is bolt-coupled to a lower surface of the oil pump holder 14. An oil seal 45 is attached to an upper end portion of the oil pump holder 14 such that its lip is in close contact with an outer peripheral surface of the pump shaft 39 at a position immediately above the ball bearing 43.

The stator shaft 37 has a large diameter portion 37*a* at its lower end. A flange 37*b* is integrally formed on an outer periphery of the large diameter portion 37*a*. The flange 37*b* is secured to the pump cover 42 by a bolt 46. A lower ball bearing 44 is mounted to its inner periphery of the flange 37*b* so as to support the output shaft 20.

Therefore, the pump shaft 39 is supported by the oil pump holder 14 via the upper ball bearing 43, and the output shaft 20 is supported by the large diameter portion 37*a* of the stator shaft 37 via the lower ball bearing 44, thereby reasonably supporting the pump shaft 39, the stator shaft 37, and the output shaft 20 and downsizing the vertical fluid power transmission including the torque converter T and output shaft 20.

Because the oil pump 41 is mounted to the oil pump holder 14 in a space between the upper and lower ball bearings 43 and 44, thereby downsizing the vertical fluid power transmission having the oil pump 41.

A thrust needle bearing 47 is interposed between the pump impeller 25 and the hub of the stator 27. A thrust needle bearing 48 is interposed between the hub of the turbine runner 26 and the transmission cover 29.

Figure 5:
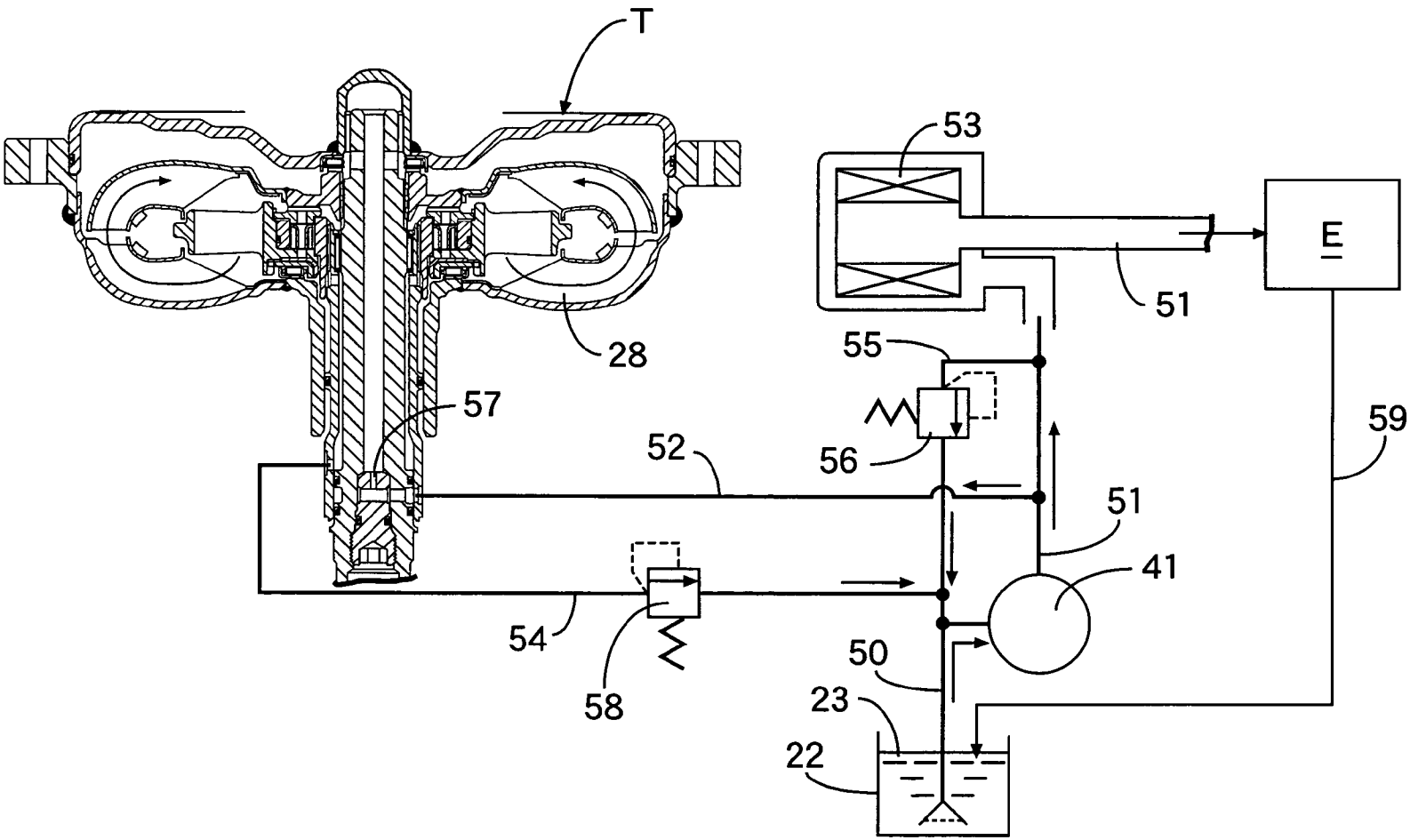
FIG. 5 is a view showing a hydraulic circuit including an oil pump.

The oil pump 41 draws up the oil stored in the oil tank 22, and supplies the oil to the engine E and the torque converter T. The route of the oil discharged by the oil pump 41 will be described below with reference to FIG. 5.

The oil pump 41 draws up the oil 23 stored in the oil tank 22 via an oil suction passage 50, and discharges the oil 23 to a first oil supply passage 51. The oil discharged to first oil supply passage 51 is filtered by an oil filter 53 provided in the middle of the first oil supply passage 51, and supplied to a lubricated portion of the engine E. After the lubrication, the oil flows downward to the bottom portion of the crankcase 19 of the engine E, and returns to the oil tank 22 via the first oil return passage 59.

The oil discharged to the first oil supply passage 51 is also supplied to a circulation circuit 28 of the torque converter T via a second oil supply passage 52 which is a branch from the first oil supply passage 51 upstream of the oil filter 53. After being used in the circulation circuit 28, the oil is returned to the oil suction passage 50 or the oil tank 22 via a second oil return passage 54.

An oil relief passage 55 is another branch from the first oil supply passage 51 upstream of the oil filter 53, and reaches the oil suction passage 50. The oil relief passage 55 has a pressure relief valve 56 which opens when an oil pressure of the first oil supply passage 51 exceeds a specified value.

The second oil supply passage 52 has an orifice 57 for controlling the amount of the oil supplied to the circulation circuit 28 of the torque converter T. The second oil return passage 54 also has a normally-closed pressure response valve 58 which opens when an oil pressure upstream of the second oil return passage 54 exceeds a predetermined value.

Thus, when the pressure of the first oil supply passage 51 is regulated by the single pressure relief valve 56, the pressure of the second oil supply passage 52 is concurrently regulated, whereby the pressure of the circulation circuit 28 in the torque converter T is regulated, and the transmission characteristics of the torque converter T can be stabilized. In addition, the downstream end of the oil relief passage 55 is connected to the oil suction passage 50, whereby the oil released from the oil relief passage 55 is smoothly returned to the oil pump 41, thereby simplifying the oil pressure circuit.

Again, in FIG. 2 and FIG. 3, the oil suction passage 50 is suspended from the oil pump holder 14, and includes a suction tube 50*a* having a lower end portion extending into the oil tank 22, and a lateral oil passage 50*b* which is provided in the oil pump holder 14 so as to communicate the upper end portion of the suction tube 50*a* with a suction port 41*a* of the oil pump 41.

The second oil supply passage 52 includes a bottomed vertical hole 52*b* which is provided at a central portion of the output shaft 20 so as to open in the upper end surface of the output shaft 20, an inlet oil passage 52*a* which is provided to pass through the fitted portions between the pump cover 42, the stator shaft 37 and the output shaft 20 so as to communicate a discharge port 41*b* of the oil pump 41 with the lower portion of the vertical hole 52*b*, and a horizontal hole 52*c* which is provided at an upper part of the vertical hole 52*b* so as to pass through the peripheral portion of the thrust needle bearing 48 into the transmission cover 29.

The second oil return passage 54 includes a cylindrical oil passage 54*a* which is defined between the output shaft 20 and the stator shaft 37 and is in communication with the circulation circuit 28 through the peripheral portion of the thrust needle bearing 47 above the hub of the pump impeller 25, and a lateral outlet oil passage 54*b* which is provided at the pump cover 42 to communicate with the lower end portion of the cylindrical oil passage 54*a*. The outlet oil passage 54*b* is in communication with the lateral oil passage 50*b* via the pressure response valve 58.

The pressure response valve 58 includes a cylindrical valve chamber 60 horizontally provided in the pump cover 42, and a piston-type valve body 61 slidably fitted in the valve chamber 60. The outlet oil passage 54*b* is open to the inner end surface of the valve chamber 60. A valve hole 62 is open in the inner side surface of the valve chamber 60 so as to communicate with the lateral oil passage 50*b* or the oil tank 22. The valve body 61 is arranged so that its top surface, that is, pressure receiving surface is directed toward the outlet oil passage 54*b*. The valve hole 62 is closed when the valve body 61 is advanced toward the outlet oil passage 54*b*, and is opened when the valve body 61 is retracted. A valve spring 63 is arranged between the rear surface of the valve body 61 and the screw plug 64 screwed into the opening of the valve chamber 60 so as to urge the valve body 61 to the advancing direction, that is, to the valve closing direction. Therefore, the valve body 61 is normally held at its closed position by a set load of the valve spring 63 to thereby block the second oil return passage 54. When an oil pressure is generated upstream of the second oil return passage 54 and exceeds a predetermined value, the top surface of the valve body 61 receives the oil pressure, and the valve body 61 is caused to retract against the set load of the valve spring 63 to be opened, whereby the second oil return passage 54 enters a communicated state.

An opening 66 (see FIG. 2) is provided in a bottom wall of the crankcase 19 of the engine E. The oil having completed the lubrication of the engine E is discharged through the opening 66. The opening 66 is opened in the upper surface of the mount case 11 through a series of vertical through holes 67 which are formed in the upper distance member 15 and the peripheral portion of the oil pump holder 14, and through the inner side portion of the annular lower distance member 13. The mount case 11 has an opening 68 which is open to the oil tank 22. Therefore, the oil which flows into the bottom portion of the crankcase 19 after completing the lubrication of the engine E is directed to return to the oil tank 22 via the opening 66, through holes 67 and the opening 68. The opening 66, the through holes 67, and the opening 68 form the first oil return passage 59.

In FIG. 3, a first seal member $\mathbf{70}_1$ is attached to the outer periphery of the stator shaft 37 so as to closely contacts the inner peripheral surface of the pump shaft 39 in a relatively rotatable manner, thereby preventing the oil in the torque converter T from flowing downward of the pump shaft 39.

A second seal member $\mathbf{70}_2$ is provided between the stator shaft 37 and the pump cover 42 at a position below the inlet oil passage 52*a*, thereby preventing the oil in the inlet oil passage 52*a* from flowing downward of the stator shaft 37 and the pump cover 42.

Third and fourth seal members $\mathbf{70}_3$ and $\mathbf{70}_4$ are provided around the outer periphery of the output shaft 20 in the fitted portions of the output shaft 20 and the stator shaft 37 such that they are arranged in the vertical direction to closely contact from above and below the inner peripheral surface of the stator shaft 37 in a relatively rotatable manner. The third and fourth seal members $\mathbf{70}_3$ and $\mathbf{70}_4$ cooperate to prevent the oil in the inlet oil passage 52*a* from flowing out of the fitted portions of the output shaft 20 and the stator shaft 37. Further, the upper seal member $\mathbf{70}_3$ prevents the oil in the inlet oil passage 54*a* from flowing downward to the fitted portions of the output shaft 20 and the stator shaft 37.

As shown in FIG. 3 and FIG. 4, the output shaft 20 is divided into an upper output shaft 20*a* having the vertical hole 52*b* and supported by the lower ball bearing 44, and a lower output shaft 20*b* coupled to the forward-reverse shifting gear mechanism 21 (see FIG. 1). An upper end portion of the lower output shaft 20*b* is supported via a bush 72 in a supporting sleeve 71 which is integrally formed with the outer side of the oil tank 22. The upper output shaft 20*a* has a flange 73 which abuts on the upper end surface of the inner lace of the ball bearing 44 attached to the inner periphery of the large diameter portion 37*a* of the stator shaft 37. A stopper collar 74 is locked to the inner peripheral surface of the large diameter portion 37*a* so as to support the lower end surface of an outer lace of the ball bearing 44. Therefore, unless the stopper collar 74 is removed, the upper output shaft 20*a* cannot be pulled out downward from the central portion of the torque converter T.

Besides the vertical hole 52*b*, the upper output shaft 20*a* has a plug hole 76 connected to the lower end of the vertical hole 52*b*, and a spline hole 77 connected to the lower end of the plug hole 76 and open in the lower end surface of the upper output shaft 20*a*. A plug 78 is screwed into the plug hole 76 to form the bottom wall of the vertical hole 52*b*. The plug 78 has a part of the inlet oil passage 52*a*, and the orifice 57 for communicating the inlet oil passage 52*a* with the vertical hole 52*b*. A fifth seal member $\mathbf{70}_5$ is attached to the plug 78 to closely contact the inner peripheral surface of the plug hole 76.

The inlet oil passage 52*a* may be formed to bypass the plug 78.

A spline shaft 80 is formed at the upper end portion of the lower output shaft 20*b*. The spline shaft 80 is fitted into the spline hole 77 to couples the upper and lower output shafts 20*a* and 20*b* to each other.

Now, operation of the outboard engine system O with the torque converter T will be described below.

In operation of the engine E, the oil pump 41 is driven by the pump shaft 39 to draw up the oil 23 in the oil tank 22 through the oil suction passage 50, that is, through the suction tube 50*a* and the lateral oil passage 50*b*, and discharges the drawn-up oil 23 to the first oil supply passage 51 and the second oil supply passage 52. The oil discharged to the first oil supply passage 51 is supplied to the lubricated portion of the engine E, as described above.

Meanwhile, the oil supplied to the second oil supply passage 52 sequentially passes through the inlet oil passage 52*a* and the orifice 57; ascend through the vertical hole 52*b* of the upper output shaft 20*a* to go out of the horizontal hole 52*c*; enters the transmission cover 29 while lubricating the thrust needle bearing 48; and then flows into the transmission cover 29 from the outer peripheral side of the turbine runner 26.

The oil in the circulation circuit 28 circulates as shown by an arrow in FIG. 3 with the rotation of the pump impeller 25 to transmit the rotational torque of the pump impeller 25 to the turbine runner 26, thereby driving the output shaft 20. At this time, if the torque is amplified between the pump impeller 25 and the turbine runner 26, the reaction force due to the amplification is borne by the stator 27, which is fixed there by the locking operation of the free wheel 38. Such a torque amplifying effect of the torque converter T strongly drives the propeller 2, thereby effectively improving start and acceleration of a ship.

After the amplification, the stator 27 rotates in the same direction together with the pump impeller 25 and the turbine runner 26 due to the reversal in the torque direction while causing the freewheel 38 to run idle.

After being used at the circulation circuit 28, the oil runs down the cylindrical oil passage 54*a* while lubricating the thrust needle bearing 47 above the hub of the pump impeller 25, and enters the valve chamber of the pressure response valve 58 from the outlet oil passage 54*b*.

The oil having entered the valve chamber 60 exerts a pressure to press the valve body 61 of the pressure response valve 58 against the set load of the valve spring 63, whereby the valve body 61 is opened to open the valve hole 62, so that the oil returns from the valve chamber 60 through the valve hole 62 into the oil suction passage 50 or the oil tank 22. In this way, the oil circulates between the circulation circuit 28 of the torque converter T and the oil tank 22 arranged below the torque converter T through the second oil supply passage 52 and the second oil return passage 54. Therefore, it is possible to downsize the torque converter T, and promote the cooling of the circulating oil to prevent degradation of the oil.

In particular, since the oil tank 22 arranged below the torque converter T is separated from the engine E, the oil tank 22 is not much heated by the engine E, the oil tank 22 can have a relatively large capacity without any interference by the engine E and the torque converter T, and thus can increase the amount of oil flowing into the circulation circuit 28, thereby further promoting the cooling of the circulating oil. Further, the engine E, the torque converter T, and the oil tank 22 are arranged in the order from top to bottom, and the torque converter T can be downsized without any interference by the oil tank 22, thereby reducing the size and weight of the outboard engine system O including these components.

The oil discharged from the oil pump 41 for lubricating the engine E is also supplied to the circulation circuit 28, which eliminates any addition/expansion of the oil tank 22 and the oil pump 41 for supplying the oil to the circulation circuit 28, thereby avoiding an increase of size and a complication of the outboard engine system O.

The elongated output shaft 20 is divided into two portions, that is, the upper output shaft 20*a* and lower output shaft 20*b* which are retractably spline-connected to each other. The upper output shaft 20*a* is coupled to the stator shaft 37 in the axial direction via the lower ball bearing 44 and the stopper collar 74. Therefore, the torque converter T, the oil pump holder 14, the pump cover 42, and the upper output shaft 20*a* are compactly incorporated into a single unit as a vertical power transmission without any interference by the lower output shaft 20*b*, thereby facilitating assemblability of the vertical power transmission and mountability of the vertical fluid power transmission to the outboard engine system O.

Further, if the gear case 12 is separated from the extension case 10 for maintenance of the forward-reverse shifting gear mechanism 21 for example, the lower output shaft 20*b* can be separated downward together with the gear case 12 while the upper output shaft 20*a* is remained on the torque converter T side by pulling the spline shaft 80 of the lower output shaft 20*b* out of the spline hole 77 of the upper output shaft 20*a*. Therefore, it is possible to easily perform the maintenance of the forward-reverse shifting gear mechanism 21, and further avoid disassembly of the vertical fluid power transmission to easily reassemble the gear case 12 into the system.

Furthermore, since the bottom wall of the vertical hole 52 as a part of the second oil supply passage 52*b*, that is, the plug 78 is screwed into the upper output shaft 20*a* of the vertical fluid power transmission, the oil is prevented from flowing out of the vertical hole 52*b* and going downward of the upper output shaft 20*a*. In this case, although the bottom wall of the vertical hole 52*b* may be integrally formed with the upper output shaft 20*a*, the vertical hole 52*b*, the plug hole 76, and the spline hole 77 are arranged to axially pass through the upper output shaft 20*a* if the plug 78 is used. Therefore, after processing of these holes, washing can advantageously reliably prevent cut chips from residing in these holes.

The same is true in the case where the engine E and the torque converter T are removed from the mount case 11, which facilitates maintenance of these components.

Moreover, the engine E is mounted to the mount case 11 via the oil pump holder 14 supporting the pump shaft 39 of the torque converter T, the upper distance member 15 connected to the upper end of the oil pump holder 14 to surround the torque converter T, and the lower distance member 13 connected to the lower end of the oil pump holder 14. Therefore, it is possible to easily mount the engine E to the mount case 11 without any interference by the torque converter T, thereby providing an excellent assemblability.

The oil pump 41 is attached to the pump housing 40 formed on the lower surface of the oil pump holder 14 and holds the pump cover 42. Therefore, the oil pump holder 14 supports not only the torque converter T but also the oil pump 41, thereby simplifying the support structure of the oil pump 41.

When the operation of the engine E is terminated, also the operation of the oil pump 41 is terminated, so that in the pressure response valve 58, the pressure of the valve chamber 60 is decreased and the valve body 61 is closed by the set load of the valve spring 63. This causes the outlet oil passage 54*b* to enter the blocked state, and prevents the oil from flowing from the circulation circuit 28 of the torque converter T into the oil tank 22, thereby keeping the circulation circuit 28 filled with the oil. Therefore, it is possible to enhance the responsiveness of operation of the torque converter T.

Because a part of the second oil supply passage 52 is the vertical hole 52*b* which is formed at the central portion of the upper output shaft 20*a* and whose upper end communicates with the circulation circuit 28, the structure of the second oil supply passage 52 can be simplified. Further, when the engine E is not operated, the vertical hole 52*b* prevents the oil from flowing back from the circulation circuit 28 into the oil pump 41.

Figure 6:
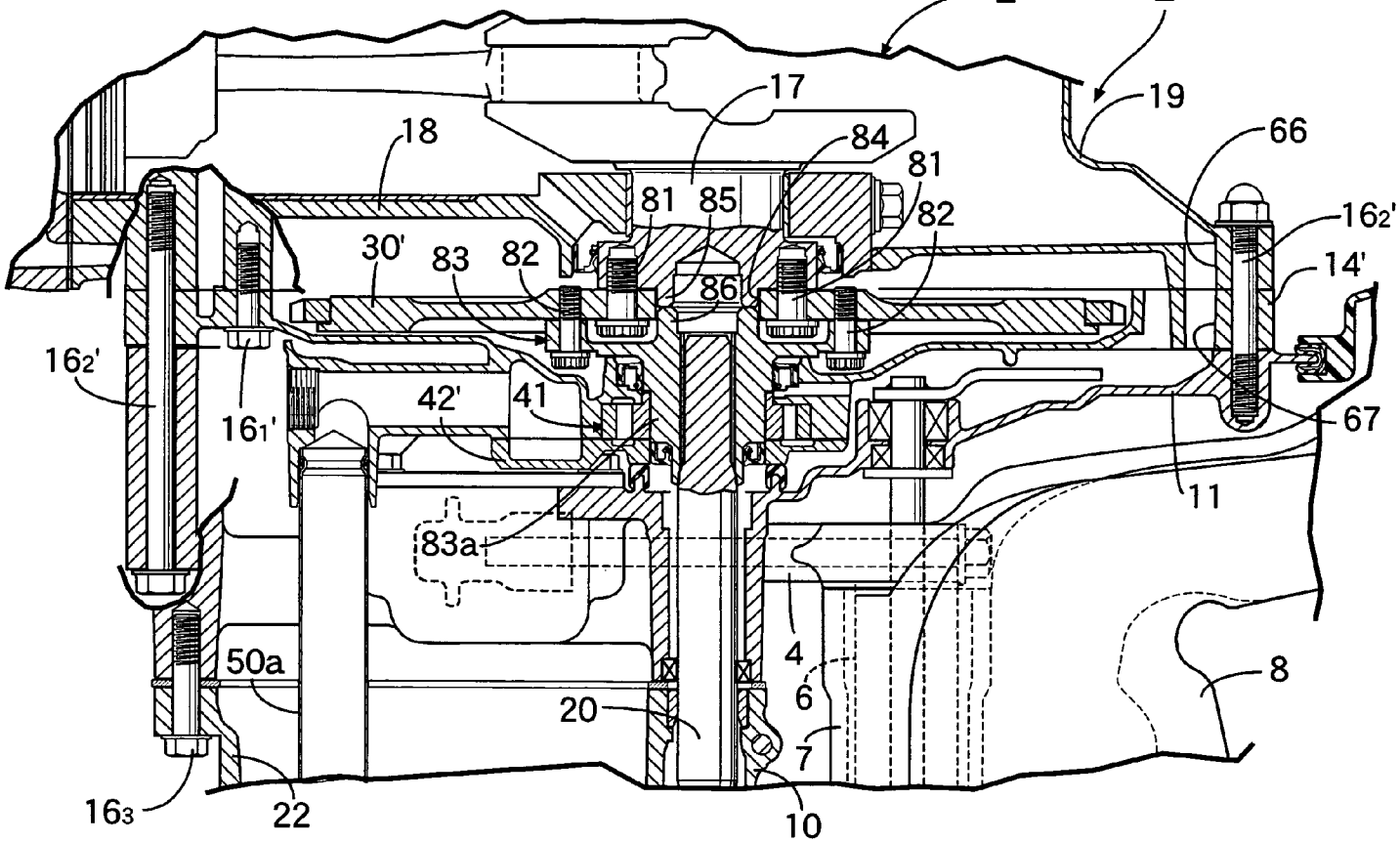
FIG. 6 is a view corresponding to FIG. 2, showing an outboard engine system without a torque converter, using the same casing main sections as those of the outboard engine system with the torque converter of FIG. 1.

In the outboard engine system O with torque converter T, the casing 1 includes the extension case 10, the mount case 11, the gear case 12, the mount case 11, the lower distance member 13, the oil pump holder 14, and the upper distance member 15. Among these components, the extension case 10, the mount case 11, and the gear case 12 cooperate to form the casing main sections of the present invention. As shown in FIG. 6, the casing main sections can be used in the outboard engine system O' without torque converter T, and in this case, the lower and upper distance members 13 and 15 are not used.

That is, in assembling the outboard engine system O' without torque converter T, as shown in FIG. 6, the oil pump holders 14' are secured to the cylinder block 18 of the engine E and the bottom wall of the crankcase 19 by a plurality of bolts $\mathbf{16}_1$'; the engine E having the oil pump holders 14' is superimposed on the mount case 11; and the mount case 11 is coupled to the cylinder block 18 of the engine E and, the bottom wall of the crankcase 19 by a plurality of bolts $\mathbf{16}_2$' with the oil pump holders 14' being sandwiched therebetween.

In this structure, a ring gear 30' for starting operation is secured to the lower end surface of the crankshaft 17 by a plurality of annularly arranged bolts 81, and a joint member 83 is secured to the lower surface of the ring gear 30' by a plurality of annularly arranged bolts 82. The joint member 83 integrally has a hub 83*a* arranged coaxially with the crankshaft 17. The upper end portion of the output shaft 20 is spline-fitted into a spline hole formed at a central part of the joint member 83.

In order to maintain the concentricity of the crankshaft 17 and the joint member 83, an alignment hole 84 is bored at the center of the ring gear 30', and annular alignment projections 85 and 86 which are projectingly provided on the opposed end faces of the crankshaft 17 and the joint member 83 are fitted from above and below into the alignment hole 84. The output shaft 20 may be a single member which is integrally continuous from its upper to lower part. The oil pump 41 attached to the oil pump holder 14' is driven by the hub 83*a*. The structure or shape of the oil pump holder 14' and the pump cover 42' is simplified because the ball bearings 43 and 44, and the pressure response valve 58 of the outboard engine system O with the torque converter T are eliminated. Components shown in FIG. 6 corresponding to those of the outboard engine system O with the torque converter T are denoted by the same reference numerals and symbols, and the duplicated description is omitted.

As can be seen from the above description, the casing main sections, that is, the extension case 10, the mount case 11 and the gear case 12 can be commonly used in the outboard engine system O with the torque converter T and also in the outboard engine system O' without the torque converter T, thereby reducing the cost in both the outboard engine systems O and O'.

The present invention is not limited to the above described embodiment, and various modifications in design can be made without departing from the subject matter of the present invention. For example, in the outboard engine system O with the torque converter T, the oil tank 22 may be divided into a section for storing working oil for the torque converter T and a section for storing lubrication oil for the engine E, and oil suitable for each purpose is stored in each portion. In both the outboard engine systems O and O', the oil pump 41 may be mounted to the engine E to omit the oil pump holders 14 and 14'.

What is claimed is:

1. An outboard engine system, including:

an engine;

a casing to which the engine is removably mounted at an upper portion;

a torque converter;

a vertically arranged output shaft connected to a crankshaft via the torque converter;

a horizontally arranged propeller shaft provided below the output shaft; and a forward-reverse shifting gear mechanism for providing a connection between the output shaft and the propeller shaft, wherein the casing includes:

a casing main section for housing the output shaft, the propeller shaft, and the forward-reverse shifting gear mechanism;

an extension member jointed to an upper end of the casing main section;

a distance member removably jointed to an upper end of the extension member so as to house the torque converter, and wherein both the casing main section and the distance member are configured to be able to removably mount the engine.

2. The engine system as claimed in claim 1, wherein the distance member comprises a lower distance member and an upper distance member.

3. The engine system as claimed in claim 2, wherein the upper distance member is annular in shape.

4. The engine system as claimed in claim 3, wherein the torque converter is vertically arranged in the upper distance member.

5. The engine system as claimed in claim 1, wherein the output shaft comprises an upper output shaft and a lower output shaft, wherein the upper output shaft and the lower output shaft are retractably spline-connected to each other.

6. The engine system as claimed in claim 5, wherein the extension member and the casing main section house the lower output shaft.

7. The engine system as claimed in claim 5, wherein the distance member houses the upper output shaft.

8. The engine system as claimed in claim 1, wherein the extension member further comprises an oil tank.

9. The engine system as claimed in claim 1, further comprising a swivel shaft, wherein the casing is horizontally rotatable around the swivel shaft.

10. The engine system as claimed in claim 1, further comprising a tilt shaft, wherein the casing is vertically tiltable around the tilt shaft.

11. The engine system as claimed in claim 1, wherein the torque converter is of a type provided in a fluid power transmission.

* * * * *